United States Patent [19]

Ellis

[11] Patent Number: 4,800,356

[45] Date of Patent: Jan. 24, 1989

[54] SHUNT TRANSFORMER

[75] Inventor: Herbert H. Ellis, Asheville, N.C.

[73] Assignee: Eaton Corporation, Cleveland, Ohio

[21] Appl. No.: 175,990

[22] Filed: Mar. 31, 1988

Related U.S. Application Data

[62] Division of Ser. No. 127,345, Dec. 1, 1987.

[51] Int. Cl.[4] ..... H01F 27/24; H01F 27/30

[52] U.S. Cl. ..... 336/184; 336/105; 336/212; 336/215; 336/234

[58] Field of Search ..... 336/184, 212, 213, 214, 336/215, 216, 221, 233, 234, 105, 107, 155, 160

[56] References Cited

U.S. PATENT DOCUMENTS 672,989 4/1901 Shoemaker ..... 336/234 X 4,471,271 9/1984 Wendt ..... 336/212 X

*Primary Examiner*—Thomas J. Kozma

*Attorney, Agent, or Firm*—C. H. Grace

[57] ABSTRACT

An AC power/step-down transformer suitable for use in switchgear for controlling electrical apparatus such as an indicator lamp has low core cost and permits economical assembly, as no interleaving of laminations is required. Its magnetic circuit comprises simple rectangular coil core assemblies whose ends are either fitted into holes in upper and lower plate assemblies or abutted against them. There are two primary and two secondary coil core assemblies, spaced apart to permit pushrods to pass between them for actuation of a back-mounted switch. A primary winding is placed around both of the primary coil core assemblies, and a secondary winding is placed around both of the secondary coil core assemblies.

5 Claims, 3 Drawing Sheets

SHUNT TRANSFORMER

This application is a division, of application Ser. No. 07,127,345, filed 12/01/87.

BACKGROUND OF THE DISCLOSURE

AC power transformers such as step-down transformers for indicator lamps are commonly constructed with' cores of E-I shaped laminations, C-C laminations, or C-I laminations. Their designs often require that their laminations be interleaved or carefully inserted in windings during assembly of the transformer. Moreover, the E and C designs are wasteful of ferromagnetic material because a great amount of scrap is produced when they are punched.

SUMMARY OF THE INVENTION

An object of this invention is to provide an AC power transformer of low core cost and economical assembly.

Another object to provide a transformer that utilizes only modified I laminations of simple shapes, entailing very little material loss, and not any E or C laminations.

Another object is to enable simple assembly by stacking of components on top of each other to form a transformer, thus eliminating costly insertion and/or interleaving of laminations.

Another object is to provide a transformer whose magnetic structure has large surface areas that help to dissipate more uniformly the heat that the transformer generates.

DETAILED DESCRIPTION OF PREFERRED EMBODIMENTS

A. Embodiment A of the transformer invention is partially shown in FIG. 1. This depicts only the magnetic circuit 1, in an exploded view. It comprises a lower plate assembly 8, which is a low reluctance heat dispersing pre-assembly of laminations. Laminations that are not pre-assembled can be employed instead if desired.

Figures 1, 3:
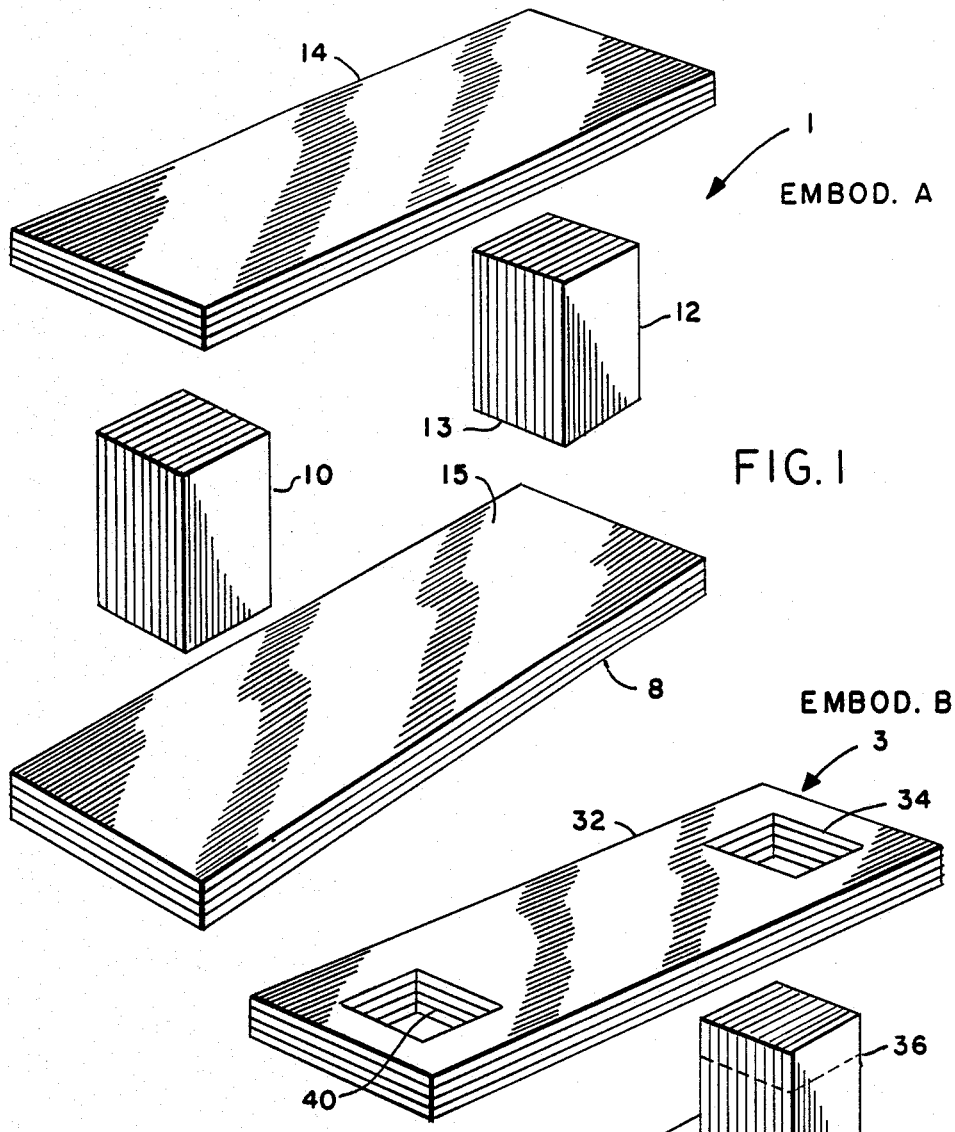
FIG. 1 embodiment A of the invention is shown. The portion i is the unassembled magnetic circuit of a transformer having one primary core and one secondary core, the ends of which will abut upper and lower laminated plates.
FIG. 3. Embodiment B of the invention is shown; illustrated is the partially assembled magnetic circuit portion of a transformer having one primary and one secondary core, the ends of which are inserted into holes in upper and lower plates.

A primary coil core assembly 10 and a secondary coil core assembly 12 are formed from a plurality of rectangular laminations as shown in FIG. 1. After assembly the lower surface of each core assembly will be in contact with the upper surface of the bottom plate 8, as shown by the surfaces 13, 15 corresponding to coil core 12. An upper plate assembly 14 of rectangular laminations is provided, which after assembly will similarly be in abutting engagement with the coil cores 10, 12.

Figure 2:
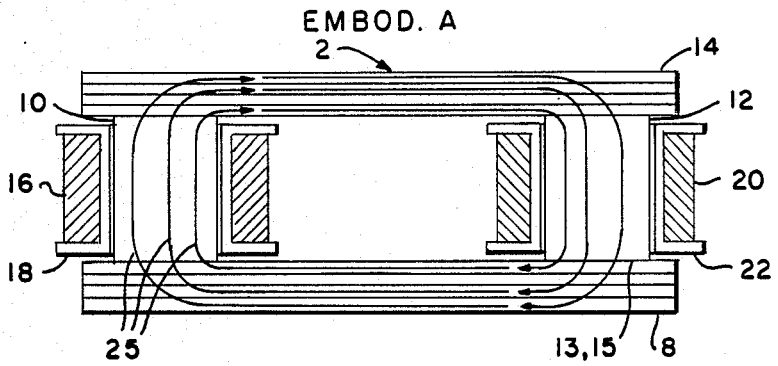
FIG. 2. Embodiment A of the invention is illustrated again, in a cutaway cross-sectional side view that shows the path by which magnetic flux links the primary and secondary coils through the abutting cores and plates.

In FIG. 2 a subassembly Portion 2 of embodiment A is shown. It includes a primary winding 16 on a primary bobbin 18, and a secondary winding 20 on a secondary bobbin 22. The interface 13, 15 is indicated on the drawing by a slightly heavier line. Three curved lines 25 representing typical magnetic flux path lines are also depicted. Their arrowheads represent the direction of magnetic flux during one half cycle of magneto motive force resulting from excitation current in the primary winding 16.

Embodiment A can be assembled by simply stacking the components one on top of another, perhaps from only one side, as in placing parts into a container, until the transformer is complete. The component parts are retained by either a simple tie-bar that holds the two end plates together, or ribs and shelves in a case and cover (not shown) that house the entire unit. The stark simplicity of the components of the magnetic circuit is evident from FIG. 1. This results in low cost and low amounts of magnetic scrap at the machines that fabricate the ferromagnetic components.

A typical assembly procedure for embodiment A is:

1. The lower plate, made up of many I laminations that are preferably pre-assembled, is the first to be placed into the transformer housing or fixturing nest.

2. The windings are installed next; they are placed on top of the lower plate. The coil cores are preferably pre-assembled into the windings but could instead be inserted after the windings are placed on the pile.

3. The top plate is then placed on the subassembly. Inadvertent omission or inclusion of parts would be obvious because it would affect the height of the stack.

4. In this step the transformer subassembly is preferably riveted together, on the housing's base, and the entire unit clamped together by rivets (or any of a number of other arrangements that are well known, e.g., posts, welds, heat bonding, etc. if preferred). The fastening devices, which are not related to the inventive concept, are not shown. One or more holes may be required in the upper and lower plates, depending upon the particular design details desired.

B. Embodiment B of FIGS. 3 and 4 involves a refinement that affords improved transformer performance, easier assembly procedures, and more reliable retention of the component parts after assembly.

In FIG. 3 a portion 3 of embodiment B is shown. This is a partially exploded view of only the magnetic circuit portion of the embodiment. A lower plate assembly 26 and an upper plate assembly 32 are stacks of rectangular laminations. Each has two rectangular holes, as exemplified by a hole 34 in the upper plate assembly 32. During assembly the primary and secondary core assemblies 28, 30 are force-fitted into the holes of the lower plate assembly 26.

Insertion depth of the cores can be controlled by providing shoulders on the coil core assemblies. The depth of insertion is selected to provide efficient transformer performance as well as convenient orientation, placement and retention of the primary and secondary coil assemblies and other parts. For good transformer performance, the coil cores must be inserted into the plate assemblies far enough that their mating surface areas can conduct the magnetic flux efficiently. Parts can be retained or their retention improved by clips or "barbs" built into the lamination assemblies.

Figure 4:
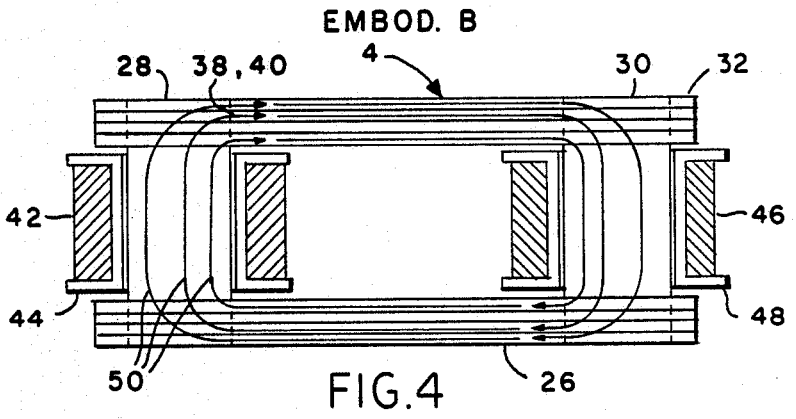
FIG. 4. Embodiment B of the invention is illustrated again, in a cutaway cross-sectional side view that shows the path by which the magnetic flux links the primary and secondary coils through cores that are inserted into the plates.

After the primary and secondary windings, on their bobbins, are assembled to the cores 28, 30, the upper plate assembly 32 is force-fitted onto the cores 28, 30 to a level shown by the dotted line 36 on core 30. Preferably, the tops of the core assemblies 28, 30 are then approximately flush with the top surface of the upper plate assembly 32. A portion of a vertical surface 38 of the primary core assembly 28 mates with a vertical surface 40 of the upper plate assembly 32. Similarly, all corresponding surfaces of the cores and plates engage in order to conduct the magnetic field Another portion 4 of embodiment B is shown in FIG. 4. It includes a primary winding 42 on a primary bobbin 44 and a secondary winding 46 on a secondary bobbin 48. The mating surfaces 38, 40 are indicated by a dotted line, as are some of the other magnetic interface surfaces between cores and plates.

Three closed loop lines 50 indicate the typical magnetic flux Path during one half cycle of magnetomotive force induced by magnetizing current in the primary winding 42. The magnetic flux travels without interruption through the longest dimensions of the laminations. It does not have to "jump" or be shunted transversely across layers of laminations, which would impair operation by introduction of effective air gaps, etc.

The dielectric voltage rating between the primary and secondary windings is of course higher if they are two separate windings. FIG. 4 illustrates clearly the separation between primary and secondary windings, with a typical placement of components.

Figure 5:
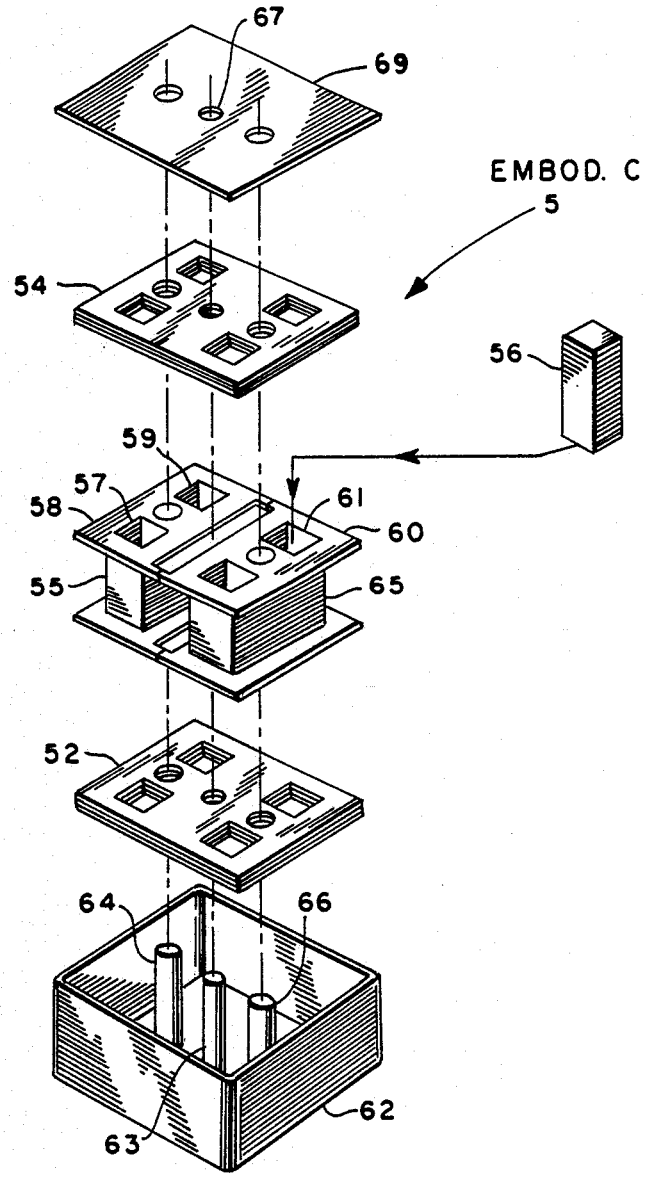
FIG. 5. Embodiment C of the invention, which has each of its secondary and secondary insertable cores split into two cores in order to make room for pushrods, is shown along with its housing in an exploded view.

C. A portion 5 of embodiment C is shown in FIG. 5. This embodiment is intended for mounting on a panel, with a lamp on the outside (the side of the upper plate), and a switch on the inside (the side of the lower plate). A primary coil 55 is prewound on a bobbin 58, which has rectangular cylindrical supports 57, 59 for two primary iron coil cores, not shown. Similarly, the secondary coil 65 is wound on a bobbin 60 whose bobbin structure includes provision for two coil cores. For example, the rectangular opening in a bobbin portion 61 is large enough to accommodate a coil core 56.

The primary magnetic structure is formed of two coil cores, and the secondary magnetic structure is formed of two coil cores, in order to provide space for axially movable pushrods that pass through tubes 64, 66 of the housing 62. The pushrods that are later assembled into these holes are moved axially by a sleeve, not shown, when the lens of a lamp is pushed manually, as will be described below.

The lower plate 52 and the upper plate 54 have rectangular holes into which the four coil cores, which are taller than the bobbins, are force-fitted during assembly. A cover 69 can be attached by heat bonding at a hole 67 to a center post 63.

Figure 6:
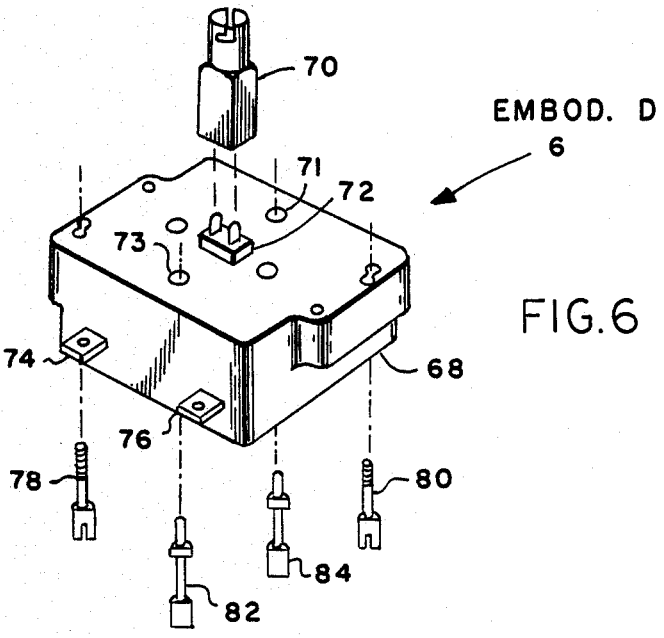
FIG. 6. Embodiment D of the invention, which is very similar to embodiment C, is shown in an environment of a few closely related components, to explain better how split core embodiments such as C and D can accommodate pass-through pushrods for acutating a back-mounted switch.

D. In FIG. 6 another embodiment, D, reference numeral 6, is seen to be very similar to embodiment C. Minor structural differences between embodiments C and D relate to details that are not part of the invention. The main assembly 68 includes a lampholder receptacle 72 having two electrical terminals, which are the secondary terminals of a transformer that is inside the assembly 68. A plug-in lamp holder 70 can be fitted onto the lampholder receptacle 72, and a lamp inserted into the bayonet socket of holder 70. Primary terminals 74, 76 receive AC input power.

Portions of the environment need not be shown in FIG. 6 in order to disclose the invention fully. A lens, not shown, which covers the lamp, engages a cylindrical sleeve, not shown, that surrounds the lamp holder 70. The sleeve is spring loaded in a direction to hold the lens away from the lamp. One end of the sleeve makes mechanical contact with two pushrods that pass through the holes 71, 73, and that are coupled to a switch assembly, not shown. The switch assembly is assembled to the light module 68 by stacking screws 78, 80.

When the lens is Pushed against the spring pressure, two contact block plungers 82, 84 operate a switch in the contact block that connects power to the transformer's primary winding terminals 74, 76. This energizes the transformer and lights the lamp. The switch in a single contact block need not be connected to the transformer's primary winding. Instead, the switch can be connected to and control other external electrical circuits. Moreover, more than one contact block (each with integral pushrods) can be ganged together and attached to the back of the transformer, thereby controlling many external circuits as well as the transformer itself if needed.

In addition to the examples above, many other embodiments can be devised that are within the scope of the invention, which is defined by the claims. For example, a variation of embodiment A would have longer coil core assemblies that extend over the ends of the upper and lower laminated plates, with the upper and lower plates sandwiched between the coil core assemblies and their ends abutting the sides of the coil core assemblies.

I claim:

1. A transformer having a primary winding, a secondary winding, and a magnetic circuit, said magnetic circuit comprising:

two primary coil core means placed spaced apart through said primary winding for conducting magnetic flux in the general direction of a principal axis, and both described as follows: having a plurality of laminations substantially all of which are of the same shape and size, and whose shape is substantially rectangular, and having first and second end portions;

two secondary coil core means placed spaced apart through said secondary winding for conducting magnetic flux in the general direction of a principal axis, and both described as follows: having a plurality of laminations, substantially all of which are of the same shape and size, and whose shape is substantially rectangular, and having first and second end portions;

first plate means for conducting magnetic flux between the first ends of said primary and secondary coil core means and having a plurality of laminations, substantially all of which are of the same shape and size, and having four rectangular interior boundaries defining spaced apart holes for accommodating insertion therein of said primary and secondary coil core means;

second plate means for conducting magnetic flux between the second ends of said primary and secondary coil core means and having a plurality of laminations, substantially all of which are of the same shape and size, and having four rectangular interior boundaries defining spaced apart holes for accommodating insertion therein of said primary and secondary coil core means;

said first end portions of all of said primary and secondary coil core means being inserted in mating relationship to said boundaries in said first plate mens for conduction of flux thereto;

said second end portions of all of said primary and secondary coil core means being inserted in mating relationship to said boundaries in said second plate means for conduction of flux thereto.

2. A transformer as in claim 1 and wherein the exterior shape of said first and second Plate means is rectangular.

3. A transformer as in claim 1 and wherein said laminations of said first plate means are the same size and shape as the laminations of said second plate means.

4. A transformer as in claim 1 and wherein said laminations of said primary coil core means are the same size as the laminations of said secondary coil core means.

5. A transformer as in claim 1 and wherein both of said first means and said second plate means further comprise interior edge means defining openings disposed intermediate the two cores of at least one of said windings, suitable for permitting passage therethrough of an axially movable pushrod.

* * * * *